US012253090B2

(12) United States Patent
Liang et al.

(10) Patent No.: US 12,253,090 B2
(45) Date of Patent: Mar. 18, 2025

(54) FAN AND CLEANING DEVICE

(71) Applicant: Beijing Roborock Technology Co., Ltd., Beijing (CN)

(72) Inventors: Yuanjian Liang, Beijing (CN); Changcheng Li, Beijing (CN); Zhimin Yang, Beijing (CN)

(73) Assignee: BEIJING ROBOROCK TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 18/262,488

(22) PCT Filed: Apr. 2, 2022

(86) PCT No.: PCT/CN2022/085083
§ 371 (c)(1),
(2) Date: Jul. 21, 2023

(87) PCT Pub. No.: WO2023/024521
PCT Pub. Date: Mar. 2, 2023

(65) Prior Publication Data

US 2024/0084811 A1 Mar. 14, 2024

(30) Foreign Application Priority Data

Aug. 25, 2021 (CN) ..... 202110979782.8

(51) Int. Cl.
*F04D 25/06* (2006.01)
*F04D 29/30* (2006.01)
(Continued)

(52) U.S. Cl.
CPC ..... *F04D 25/062* (2013.01); *F04D 29/30* (2013.01); *F04D 29/384* (2013.01); *F04D 29/444* (2013.01)

(58) Field of Classification Search
CPC ..... F04D 25/062; F04D 29/30; F04D 29/384; F04D 29/444; H02K 5/173; H02K 5/20; H02K 7/08; H02K 9/06
See application file for complete search history.

(56) References Cited

U.S. PATENT DOCUMENTS

2006/0280596 A1* 12/2006 Kim ..... F04D 29/666 415/119
2014/0003972 A1 1/2014 Cho
(Continued)

FOREIGN PATENT DOCUMENTS

CN 1440493 A 9/2003
CN 101285476 A 10/2008
(Continued)

OTHER PUBLICATIONS

Taiwanese Office action from Application No. TW111121106 dated Dec. 23, 2022.
(Continued)

*Primary Examiner* — Woody A Lee, Jr.
*Assistant Examiner* — Eric A Lange
(74) *Attorney, Agent, or Firm* — Calfee, Halter & Griswold LLP

(57) ABSTRACT

A fan includes a rotor; a stator; a first bearing assembly disposed at a radial outer side of an end of the rotor; and an impeller including an impeller body, where the impeller body is provided with a receiving cavity for receiving the first bearing assembly; and one end of the first bearing assembly is disposed in the receiving cavity, and the rotor, the first bearing assembly and the impeller body are disposed coaxially.

12 Claims, 4 Drawing Sheets

(51) Int. Cl.
*F04D 29/38* (2006.01)
*F04D 29/44* (2006.01)

(56) References Cited

U.S. PATENT DOCUMENTS

| | | | | |
|---|---|---|---|---|
| 2018/0266426 | A1 | 9/2018 | Lee et al. | |
| 2019/0365167 | A1 | 12/2019 | Jung | |
| 2022/0060087 | A1 * | 2/2022 | Yan | H02K 5/20 |

FOREIGN PATENT DOCUMENTS

| | | | | |
|---|---|---|---|---|
| CN | 102748323 | A | | 10/2012 |
| CN | 105790505 | A | | 7/2016 |
| CN | 210423107 | U | | 4/2020 |
| CN | 111963484 | A | | 11/2020 |
| CN | 212079745 | U | * | 12/2020 |
| CN | 112343841 | A | | 2/2021 |
| CN | 212536246 | U | | 2/2021 |
| CN | 212543466 | U | | 2/2021 |
| DE | 2742962 | A1 | | 4/1979 |
| JP | H063197 | B2 | | 1/1994 |
| JP | 2013072360 | A | * | 4/2013 |
| KR | 20180069490 | A | | 6/2018 |
| KR | 2186247 | B1 | * | 12/2020 |
| KR | 20200145790 | A | | 12/2020 |

OTHER PUBLICATIONS

Chinese Office action from 202110979782.8 dated Mar. 30, 2023.
International Search Report from PCT/CN2022/085083 dated Jul. 8, 2022.
3rd Office Action of Chinese Patent No. 202110979782.8 dated May 31, 2024.

* cited by examiner

FAN AND CLEANING DEVICE

CROSS-REFERENCE TO RELATED APPLICATION

This application is a US national phase of PCT international application No. PCT/CN2022/085083, which claims priority of the Chinese Patent Application No. 202110979782.8, filed on Aug. 25, 2021, both are incorporated herein by reference in their entirety.

TECHNICAL FIELD

The present disclosure relates to the field of fans, and in particular to a fan and a cleaning device.

BACKGROUND

A fan is a driven fluid machine that increases gas pressure and discharges gas depending on mechanical energy converted from input electric energy. In China, the fan is a conventional abbreviation of gas compression and gas conveying machinery, and generally includes ventilators, blowers and wind turbines.

Fans are mainly applied to various national economic fields such as metallurgy, petrochemical industry, electric power, urban rail transit, textiles and shipping, and ventilation in different places. In addition to the traditional application fields, fans also have great development prospects in more than 20 potential market fields such as comprehensive utilization of coal gangue, technical transformation of new dry-process clinkers, energy saving and comprehensive utilization of resources in metallurgical industry.

However, the fan has many components, and thus usually has a problem of very large volume.

SUMMARY

(I) Object of the Present Invention

An object of the present disclosure is to provide a fan and a cleaning device. In the fan according to embodiments of the present disclosure, an impeller body is provided with a receiving cavity, and an end of a first bearing assembly is disposed in the receiving cavity of the impeller body to reduce an axial length of the fan, thereby decreasing the volume of the fan.

(II) Technical Solution

In order to solve the above problem, according to a first aspect of the present disclosure, there is provided a fan. The fan includes a rotor; a first bearing assembly disposed at an outer side of an end of the rotor; and an impeller including an impeller body, wherein the impeller body has a receiving cavity for receiving the first bearing assembly, one end of the first bearing assembly is disposed in the receiving cavity, and the rotor, the first bearing assembly and the impeller body are disposed coaxially.

In some embodiments, the fan further includes an axial diffuser that is in an axial direction of the rotor and disposed between the impeller and a stator, wherein the other end of the first bearing assembly is disposed in a central hole of the axial diffuser.

In some embodiments, the axial diffuser includes a cylinder, and a diffuser body and a diffusion vane that are disposed in the cylinder, wherein the diffusion vane is disposed between the cylinder and the diffuser body and obliquely disposed along an axial direction of the cylinder.

In some embodiments, there is a plurality of axial diffusers, and the plurality of axial diffusers is coaxially disposed to form a multi-stage axial diffuser; and a first-stage axial diffuser in the multi-stage axial diffuser sleeves the first bearing assembly, and a final-stage axial diffuser in the multi-stage axial diffuser is fixedly connected to the stator.

In some embodiments, the diameter of an inner wall of the diffuser body of at least the final-stage axial diffuser in the multi-stage axial diffuser is equal to the outer diameter of the stator.

In some embodiments, in the multi-stage axial diffuser, the diameter of the inner wall of the diffuser body of each stage of axial diffuser is equal to the outer diameter of the stator.

In some embodiments, each stage of the axial diffuser is provided with an air outlet and an air inlet, wherein, in the multi-stage axial diffuser, the air outlet of a previous-stage axial diffuser is docked with the air inlet of a next-stage axial diffuser.

In some embodiments, the number of the vanes of the axial diffuser is progressively increased from the first-stage axial diffuser to the final-stage axial diffuser.

In some embodiments, the number of blades of the impeller is odd.

According to a second aspect of the present disclosure, there is further provided a cleaning device. The cleaning device includes the fan according to the first aspect.

(III) Beneficial Effect

The above technical solutions of the present disclosure have the following beneficial technical effects.

In the fan according to the embodiments of the present disclosure, the impeller body of the fan is provided with the receiving cavity for receiving the first bearing assembly, and the first bearing assembly may be disposed in the receiving cavity, so that the axial volume of the fan is decreased, an overall length of the fan is reduced, and a shaft extension at a blade side is shortened, thereby improving the stability of the blades.

Numerals of the drawings are described as follows:

1: rotor; 2: first bearing assembly; 21: bearing body; 22: first bearing; 23: second bearing; 3: impeller; 31: impeller body; 32: blade; 4: axial diffuser; 41: cylinder; 411: first annular protrusion; 42: diffuser body; 421: positioning column; 422: central shaft hole; 43: diffusion vane; 44: diffusion air channel; 5: stator; 6: air hood; 61: impeller chamber; 62: annular gridless channel; 63: second annular protrusion; 7: circuit board; 8: housing; 81: air inlet; 82: air outlet; and 9: second bearing assembly.

DETAILED DESCRIPTION

The present disclosure will be described below in further detail in conjunction with the specific embodiments and with reference to the accompanying drawings, to present the objects, technical solutions and advantages of the present disclosure more clearly. It should be understood that these descriptions are merely exemplary and are not intended to limit the scope of the present disclosure. In addition, descriptions of well-known structures and technology are omitted in the following explanation to avoid unnecessarily obscuring the concept of the present disclosure.

Apparently, the described embodiments are merely a part of embodiments of the present disclosure, not all embodiments of the present disclosure. All other embodiments achieved by those of ordinary skills in the art, based on the embodiments of the present disclosure without creative work, shall fall within the protection scope of the present disclosure.

In the description of the present disclosure, it should be noted that terms "first", "second" and "third" are merely for the purpose of description and should not be understood as indicating or implying relative importance.

In addition, technical features involved in different embodiments of the present disclosure described below may be combined with each other on the precondition of no conflicts.

For convenience of description, directions are described as follows: an axial direction of a fan is a direction in which the length of a rotor extends, wherein along the axial direction of the fan, a side facing an impeller 3 is a front side of the fan, and a side facing a circuit board 7 of the fan is a rear side of the fan.

Figure 1A:
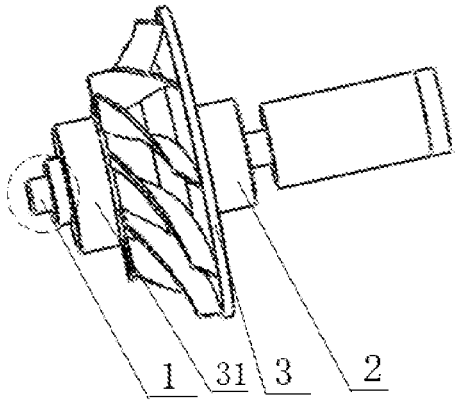
FIG. 1A is a schematic diagram of a partial structure of a fan according to a first embodiment of the present disclosure.
Figure 1B:
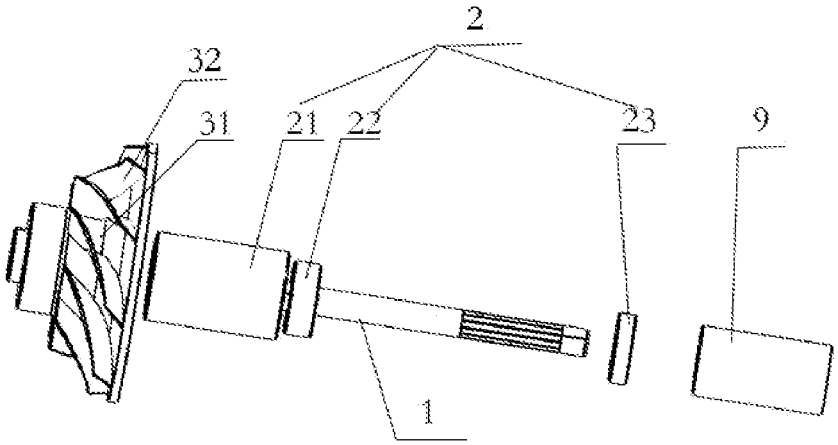
FIG. 1B is an exploded view of the partial structure of the fan according to the embodiment shown in FIG. 1A

FIG. 1A is a schematic diagram of a partial structure of a fan according to a first embodiment of the present disclosure; FIG. 1B is an exploded view of the partial structure of the fan according to the embodiment shown in FIG. 1A; and FIG. 1C is a perspective view of the partial structure of the fan according to the embodiment shown in FIG. 1A.

Figure 1C:
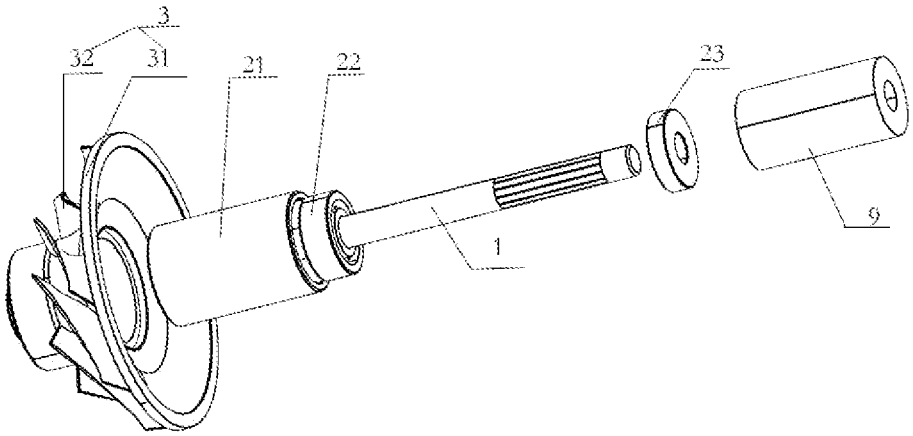
FIG. 1C is a perspective view of the partial structure of the fan according to the embodiment shown in FIG. 1A

As shown in FIGS. 1A to 1C, the fan includes a rotor 1, a first bearing assembly 2 and an impeller 3. The first bearing assembly 2 is disposed at a radial outer side of an end of the rotor 1. The impeller 3 includes an impeller body 31, the impeller body 31 is provided with a receiving cavity for receiving the first bearing assembly 2, and one end of the first bearing assembly 2 is disposed in the receiving cavity. The rotor 1, the first bearing assembly 2 and the impeller body 31 of the impeller 3 are disposed coaxially. The impeller 3 rotates along with the rotation of the rotor 1 at a tail end of the rotor on the front side of the fan.

In the embodiment shown in FIG. JA to FIG. 1C, the impeller 3 is composed of the impeller body 31 and blades 32 disposed on the impeller body 31. That is, all parts except the blades 32 on the impeller 3 are the impeller body 31.

In some embodiments, the first bearing assembly 2 includes a bearing body 21, and a first bearing 22 and a second bearing 23 that are disposed at both ends of the bearing body 21 respectively. The first bearing 22 is disposed at an end of the bearing body 21 facing the front side of the fan, and the second bearing 23 is disposed at an end of the bearing body 21 facing the rear side of the fan. In this embodiment, a shaft extension a of the fan refers to a distance from the tail end of the rotor 1 located on the front side of the fan to a middle location of the first bearing 22 along the axial direction of the fan. Reference is made to a dotted line in the embodiment shown in FIG. 1A and a length of the shaft extension a marked in FIG. 4.

Figure 7:
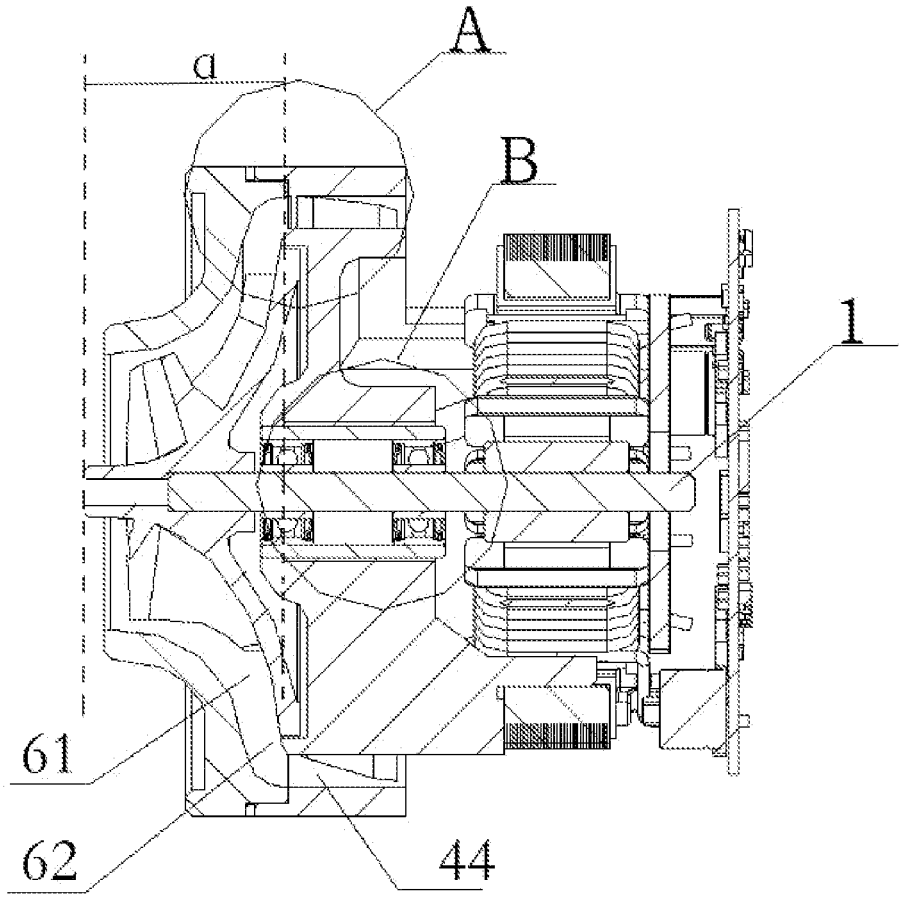
FIG. 7 is a structural schematic diagram of a fan in the related art.

FIG. 7 is a structural schematic diagram of a fan. In the fan shown in FIG. 7, since the impeller body 31 is provided with no receiving cavity, and the bearing assembly is disposed outside the impeller 3. That is, a side of the impeller body 31 close to the first bearing assembly 2 is of a solid structure, i.e., has no receiving cavity, and the first bearing assembly 2 is in direct contact with the center of the impeller body 31.

Figure 4:
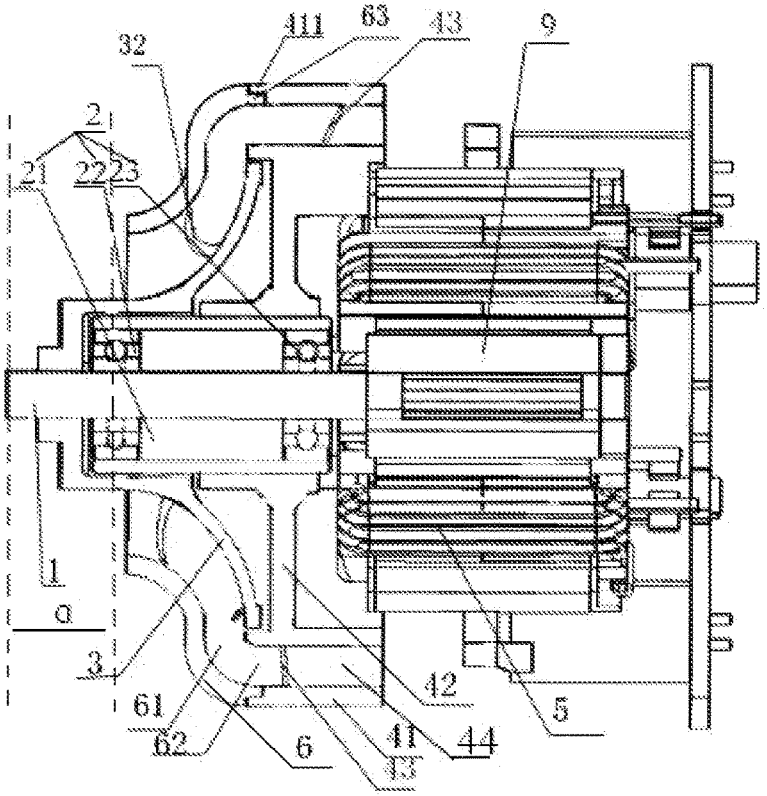
FIG. 4 is a sectional view of a fan according to a fourth embodiment of the present disclosure.

Comparing FIG. 7 with FIGS. 1A to 1C of the embodiment and FIG. 4, it can be clearly seen that, by disposing the receiving cavity for receiving one end of the first bearing assembly 2 on a side of the impeller body 31 close to the first bearing assembly 2, one end of the first bearing assembly 2 is embedded into the impeller 3 of the fan, so that the axial length of the fan and thus the overall length of the fan are reduced. Since the first bearing assembly 2 is embedded into the impeller 3 of the fan, the shaft extension a at the blade side can be shortened. As a supporting point is located at the middle location of the first bearing 22, a distance from the supporting point to a rotation transmission end is decreased to relatively enhance the rigidity of the shaft extension a, and the oscillation of the tail end of the rotor 1 driving the impeller 3 is reduced to improve the rotation stability of the impeller 3.

Figure 2:
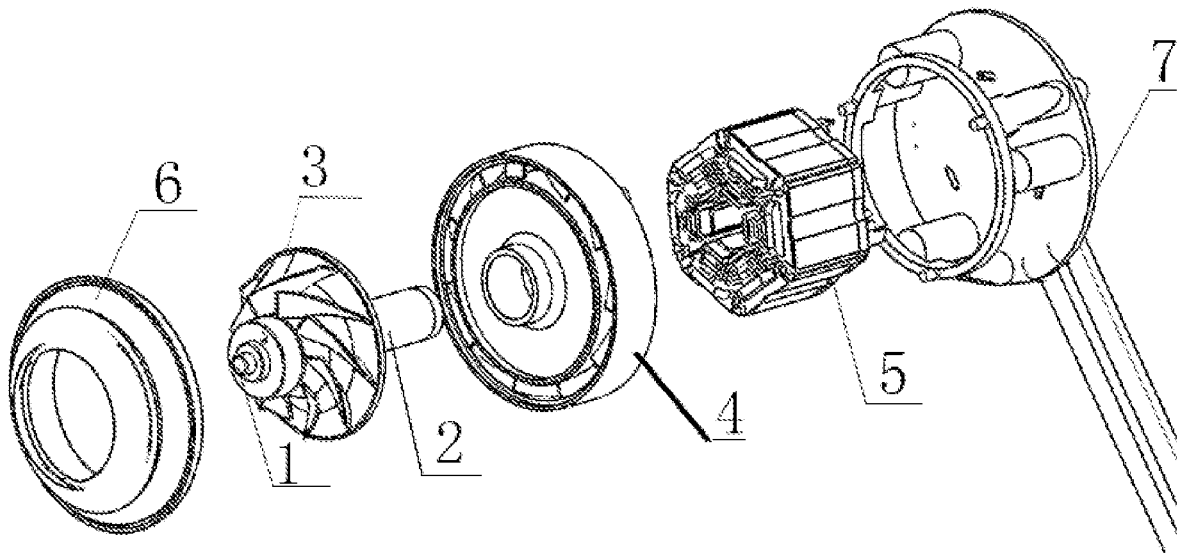
FIG. 2 is a structural schematic diagram of a fan according to a second embodiment of the present disclosure.

FIG. 2 is a structural schematic diagram of a fan according to a second embodiment of the present disclosure.

As shown in FIG. 2, the fan further includes an axial diffuser 4 that is in an axial direction of the stator 5 and disposed between the impeller 3 and the stator 5. One end of the first bearing assembly 2 is disposed in the receiving cavity of the impeller body 31, and the other end of the first bearing assembly 2 is disposed in a central shaft hole 422 of the axial diffuser 4. That is, the axial diffuser 4 is disposed outside the other end of the first bearing assembly 2. In other words, the axial diffuser 4 sleeves the other end of the first bearing assembly 2.

In some embodiments, the receiving cavity is formed on a surface of the impeller body 31 of the impeller 3 facing the stator 5.

In some embodiments, the axial diffuser 4 is cylindrical.

In some embodiments, the stator 5 is of an annular structure; and the fan further includes a second bearing assembly 9. The second bearing assembly 9 is embedded into the stator 5, and has a hollow structure with the rotor 1 disposed therein. The stator 5 generates an alternating magnetic field by an alternating current to drive the rotor 1 to rotate, and the second bearing assembly 9 ensures that the rotor 1 smoothly rotates inside the stator 5.

Figure 3:
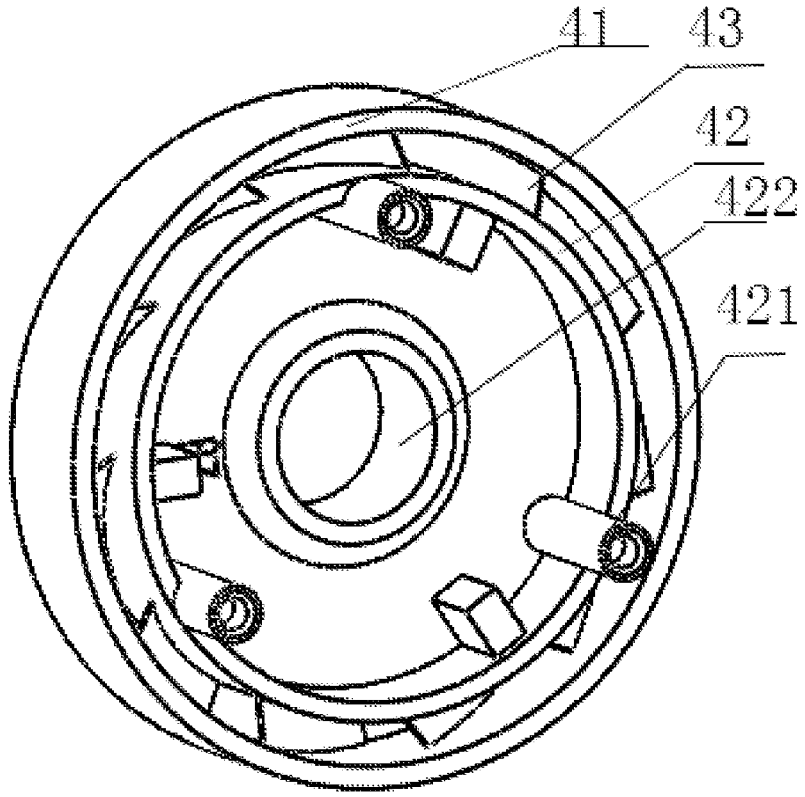
FIG. 3 is a structural schematic diagram of an axial diffuser according to a third embodiment of the present disclosure.

FIG. 3 is a structural schematic diagram of an axial diffuser according to a third embodiment of the present disclosure.

As shown in FIG. 3, the axial diffuser 4 includes a cylinder 41, and a diffuser body 42 and a diffusion vane 43 that are disposed in the cylinder 41. The diffusion vane 43 is disposed between the cylinder 41 and the diffuser body 42 and obliquely disposed along an axial direction of the cylinder 41.

In some embodiments, one end of the diffusion vane 43 is connected to an inner wall of the cylinder 41, and the other end of the diffusion vane 43 is connected to an outer wall of the diffuser body 42.

In some embodiments, there is a plurality of diffusion vanes 43, and the plurality of diffusion vanes 43 is uniformly disposed in an annular channel formed by the cylinder 41 and the diffuser body 42, and divides the annular channel into a plurality of diffusion air channels 44.

In some embodiments, the diffusion vane 43 is of, for example, a sheet-like structure.

In some embodiments, the center of the diffuser body 42 is provided with a central shaft hole 422, and the first bearing assembly 2 is disposed in the central shaft hole 422 of the diffuser body 42 and located between the rotor 1 and the diffuser body 42 to prevent the axial diffuser 4 from moving along with the rotation of the rotor 1.

In some embodiments, an end of the axial diffuser 4 away from the impeller 3 is connected to the stator 5, and the stator 5 is connected to a circuit board 7.

In this embodiment, the impeller 3 introduces air into the fan, and the air enters the axial diffuser 4 under the drive of the impeller 3, flows from an air inlet of the axial diffuser 4 to the diffusion air channel 44, and then flows out of the fan after being subjected to flow adjustment by the axial diffuser 4. The air flowing out may be used to cool winding coils of the stator 5 and the circuit board 7.

In some embodiments, there is a plurality of axial diffusers 4, and the plurality of axial diffusers 4 is coaxially disposed to form a multi-stage axial diffuser; and a first-stage axial diffuser 4 in the multi-stage axial diffuser sleeves the other end of the first bearing assembly 2, and a final-stage axial diffuser 4 in the multi-stage axial diffuser is fixedly connected to the stator 5.

In some embodiments, two adjacent stages of axial diffusers 4 may be fixedly connected by glue, engaged by, for example, a buckle and a pawl, or connected by a fastener. For example, the pawl is axially disposed on a previous-stage axial diffuser 4, and the buckle is disposed on a surface of a next-stage axial diffuser 4 close to the previous-stage axial diffuser 4.

In some embodiments, the diameter of an inner wall of the diffuser body 42 of at least the final-stage axial diffuser 4 in the multi-stage axial diffuser is equal to an outer diameter of the stator 5.

In some embodiments, the diameter of the inner wall of the diffuser body 42 of the axial diffuser 4 is equal to the outer diameter of the stator 5, so that the air can smoothly flow out of the axial diffuser 4. In addition, since the axial diffuser 4 is connected to the stator 5, the air flowing out from the diffusion air channel 44 of the axial diffuser 4 can directly flow through an outer side of the stator 5 and take away the heat on the outer side of stator 5 and the heat of the circuit board 7, so as to cool the stator 5 and the circuit board 7. In an embodiment of the present disclosure, the diameter of the inner wall of the diffuser body 42 is equal to the outer diameter of the stator 5, so that the air can smoothly flow from the axial diffuser 4 through the outer side of the stator 5, thereby reducing the air resistance and improving the fluid efficiency.

In some embodiments, in the multi-stage axial diffuser, the diameter of the inner wall of the diffuser body 42 of each stage of axial diffuser 4 is equal to the outer diameter of the stator 5.

In an embodiment of the present disclosure, there may also be a certain error between the diameter of the inner wall of the diffuser body 42 of the final-stage axial diffuser 4 and the outer diameter of the stator 5. For example, the diameter of the inner wall of the final-stage diffuser body 42 is slightly greater than the outer diameter of the stator 5. For example, a surface of the diffuser body 42 close to the stator 5 is recessed in a direction away from the stator 5 to form a recess, and the size of an inner contour of the recess matches an outer contour of the stator 5, so that a part of the stator 5 is disposed in the recess and the stator 5 and the diffuser body 42 can be assembled tightly.

In some embodiments, the depth of the recess is, for example, 1 cm.

In some embodiments, in the multi-stage axial diffuser, an air outlet of a previous-stage axial diffuser 4 is docked with an air inlet of a next-stage axial diffuser 4, so that the multi-stage axial diffuser may be of a series-connection structure.

In some embodiments, a circuit board 7 is further included. The circuit board 7 is electrically connected to winding coils of the stator 5, and disposed at an end of the stator 5 away from the axial diffuser 4.

It may be understood that the diameter of the inner wall of the final-stage axial diffuser 4 is equal to the outer diameter of the stator 5, so that the air flow from the air outlet of the final-stage axial diffuser 4 can cool windings of an electrical machine and the circuit board 7 better.

In this embodiment, the impeller 3 introduces the air into the fan, and the air enters the first-stage axial diffuser 4 under the drive of the impeller 3, flows from the air inlet of the first-stage axial diffuser 4 to the diffusion air channel 44 and then flows from the air outlet of the first-stage axial diffuser 4 and the air inlet of the next-stage axial diffuser 4 to the next-stage axial diffuser 4, flows out from the air outlet of the final-stage axial diffuser 4, and finally flows out of the fan after being subjected to flow adjustment by the multi-stage axial diffuser 4. The air flowing out may be used to cool the winding coils of the stator 5 and the circuit board 7.

FIG. 4 is a sectional view of a fan according to a fourth embodiment of the present disclosure.

As shown in FIG. 4, the fan further includes an air hood 6 fixedly connected to the axial diffuser 4.

In some embodiments, the air hood 6 is connected to the cylinder 41 of the first-stage axial diffuser 4 in the multi-stage axial diffuser 4.

An end of the air hood 6 away from the axial diffuser 4 is provided with a central hole, and the impeller body 31 of the impeller 3 passes through the central hole of the air hood 6 and extends from the air hood 6.

The impeller 3 is disposed at an outer side of an end of the bearing body 21 in contact with the rotor 1. An end of the impeller 3 in contact with the bearing body 21 and an end of the bearing body 21 close to the impeller 3 pass through and protrude from the air hood 6. In some embodiments, an impeller chamber 61 is disposed in the air hood 6, and the impeller 3 is disposed in the impeller chamber 61. The air hood 6 and the axial diffuser 4 form an annular gridless channel 62 surrounding the impeller chamber 61, the annular gridless channel 62 is communicated with the impeller chamber 61 and the air inlet of the first-stage axial diffuser 4, and the air hood 6 is provided with an air inlet.

In some embodiments, the impeller 3 and the central hole of the air hood 6 are disposed coaxially, the impeller 3 is disposed in the impeller chamber 61 and used to introduce the air from the air inlet of the air hood 6, and the air enters the first-stage axial diffuser 4 in the multi-stage axial diffuser through the annular gridless channel 62 under the drive of the impeller 3, flows from the air inlet of the first-stage axial diffuser 4 to the diffusion air channel 44, and then flows from the air outlet of the first-stage axial diffuser 4 to the diffusion air channel 44 of the next-stage axial diffuser 4 sequentially, and finally flows out from the air outlet of the final-stage axial diffuser 4. The air flowing out may be used to cool winding coils of the stator 5 and the circuit board 7.

In some embodiments, a first annular protrusion 411 is provided on an end face of a side of the cylinder 41 of the first-stage axial diffuser 4 close to the air hood 6 to form a first stepped face on the end face of the cylinder 41 of the first-stage axial diffuser 4. Optionally, the first annular protrusion 411 is formed by the extension of a side of an outer wall surface of the cylinder 41 of the first-stage axial diffuser 4 along a direction axially close to the air hood 6. A second annular protrusion 63 is provided on an end face of a side of the air hood 6 close to the first-stage axial diffuser 4 to form a second stepped face on the end face of the air hood 6 connected to the cylinder 41 of the first-stage axial diffuser 4. The second stepped face matches the first stepped face. Optionally, the second annular protrusion 63 is formed by the extension of a side of an inner wall surface of a side of the air hood 6 close to the axial diffuser 4 along the axial direction. The stepped face is disposed at a location where the cylinder 41 of the first-stage axial diffuser 4 is connected to the air hood 6, so that the smoother transition of the inner wall surface of the location where the air hood 6 is connected to the cylinder 41 can be achieved, thereby reducing the disturbance to the fluid.

In some embodiments, a positioning column 421 is disposed on one of the axial diffuser 4 and the stator 5, and a positioning hole is disposed on the other of the axial diffuser 4 and the stator 5. The axial diffuser 4 and the stator 5 are positioned and connected by cooperation of the positioning column 421 and the positioning hole.

In some specific embodiments, there is a plurality of axial diffusers 4, and the plurality of axial diffusers forms a multi-stage axial diffuser. One of the final-stage axial diffuser 4 in the multi-stage axial diffuser and the stator 5 includes a plurality of positioning columns 421, and the other of the final-stage axial diffuser 4 and the stator 5 includes a plurality of semicircular holes matching the positioning columns 421. The positioning columns 421 and the semicircular holes are disposed on the final-stage axial diffuser 4 and the stator 5 correspondingly and respectively, thereby facilitating the connection and fixing between the axial diffuser 4 and the stator 5.

In some embodiments, the stator 5 is a stator ring surrounded by a plurality of stator units. In an inner circumferential direction of the stator 5, stator teeth are disposed on each stator unit respectively, and are wound by winding coils.

In some embodiments, positioning columns 421 may be disposed on the diffuser body 42 of the final-stage axial diffuser 4 (refer to FIG. 3). Semicircular holes (not shown in the figure) may be disposed on the stator 5, for example, on an outer circumference of the stator ring.

In some embodiments, there are three positioning columns 421, and the three positioning columns 421 are disposed on the diffuser body 42 of the axial diffuser 4 respectively.

In some embodiments, three positioning columns 421 are distributed in an isosceles triangle in a circumferential direction of the axial diffuser 4. The three positioning columns 421 can ensure the positioning of the axial diffuser 4 and the stator 5. The positioning columns 421 being uniformly distributed in the circumferential direction of the axial diffuser 4 can achieve the assembly of the axial diffuser 4 and the stator 5.

In some embodiments, the positioning column 421 extends along the axial direction of the axial diffuser 4. In an embodiment of the present disclosure, the positioning column 421 is disposed to extend along the axial direction of the axial diffuser 4, so that the positioning column 421 can have a sufficient strength without affecting a structure of the axial diffuser 4, and the material consumption can be reduced at the same time.

In some embodiments, two adjacent stages of axial diffusers 4 are connected by a fastener, such as screws or bolts.

In some embodiments, two adjacent stages of axial diffusers 4 are fixedly connected by glue.

In some embodiments, two adjacent stages of axial diffusers 4 are engaged by, for example, a buckle and a pawl. For example, the pawl is axially disposed on a previous-stage axial diffuser 4, and the buckle is disposed on a surface of a next-stage axial diffuser 4 close to the previous-stage axial diffuser 4.

In some embodiments, in the multi-stage axial diffuser, the cylinders 41 of all stages of axial diffusers 4 have the same outer diameter.

In some embodiments, in the multi-stage axial diffuser 4, a third annular protrusion is provided on an end face of a side of the previous-stage axial diffuser 4 close to the next-stage axial diffuser 4 among axial diffusers from a second-stage axial diffuser 4 to the final-stage axial diffuser 4 to form a third stepped face on the end face of the previous-stage axial diffuser 4 connected to the cylinder 41 of the next-stage axial diffuser 4. A fourth annular protrusion is provided on an end face of a side of the next-stage axial diffuser 4 close to the previous-stage axial diffuser 4 to form a fourth stepped face on the end face of the next-stage axial diffuser 4 connected to the cylinder 41 of the previous-stage axial diffuser 4. The third stepped face matches the fourth stepped face. The stepped face disposed is at a location where two adjacent axial diffusers 4 are connected, so that the smoother transition of an inner wall surface of the location where the cylinder 41 of the previous-stage axial diffuser 4 is connected to the cylinder 41 of the next-stage axial diffuser 4 can be achieved, thereby reducing the disturbance to the fluid.

In some embodiments, the number of blades 32 of the impeller 3 is odd. For example, the number of blades of the impeller 3 is 3, 5, 7, 9, 11, or the like. The number of blades of the impeller 3 is mainly used to maintain the stability of a flow field. Generally, the blades 32 will vibrate during high-speed rotation. If the number of blades 32 is designed to be even, the vibration of the blades 32 will be transmitted to the opposite blades 32 due to the symmetry of the even number of blades 32, which easily causes resonance and thus increases noise and overall vibration. If the number of blades 32 is odd, although the vibration of the blades 32 still exists, no resonance is generated due to no opposite blade 32, thereby effectively reducing the noise and the overall vibration. Thus, in this embodiment, the number of blades 32 of the impeller 3 is odd to reduce a residual stress of asymmetric injection molding, thereby decreasing the resonance and improving the stability.

In some embodiments, the number of blades 32 of the impeller 3 and the number of diffusion vanes 43 are not multiples of each other. The number of diffusion vanes 43 is selected so as not to be exactly divided by the number of blades 32 of the impeller 3, thereby reducing air noise. For example, the number of blades 32 of the impeller 3 is 5, and the number of diffusion vanes 43 is 12.

In some embodiments, the number of diffusion vanes 43 is a multiple of 3, such as 9, 12, 15, or the like. Certainly, in an embodiment of the present disclosure, the number of diffusion vanes 43 may also be a number other than the multiple of 3.

In some embodiments, the number of blades 32 of the impeller 3 is less than the number of diffusion vanes 43. While the number of blades 32 of the impeller 3 satisfies the air draft efficiency, the number of diffusion vanes 43 also conforms to the flow adjustment efficiency.

The fan according to the embodiments of the present disclosure is provided with the multi-stage axial diffuser, so that the chaotic air flow from the impeller 3 directly enters the multi-stage axial diffuser via the annular gridless channel 62, and tends to flow stably after being guided by diffusion vanes 43 of the multi-stage axial diffuser, thereby reducing vortexes in the flow channel. Further, since the multi-stage axial diffuser is disposed in this embodiment, the air flowing out can have a larger pressure and flow from the multi-stage axial diffuser to winding coils of the stator 5 and the circuit board 7, thereby quickly cooling the winding coils and the circuit board 7.

According to another embodiment of the present disclosure, there is provided a cleaning device. The cleaning device includes the fan according to the embodiments of the present disclosure.

Figure 5:
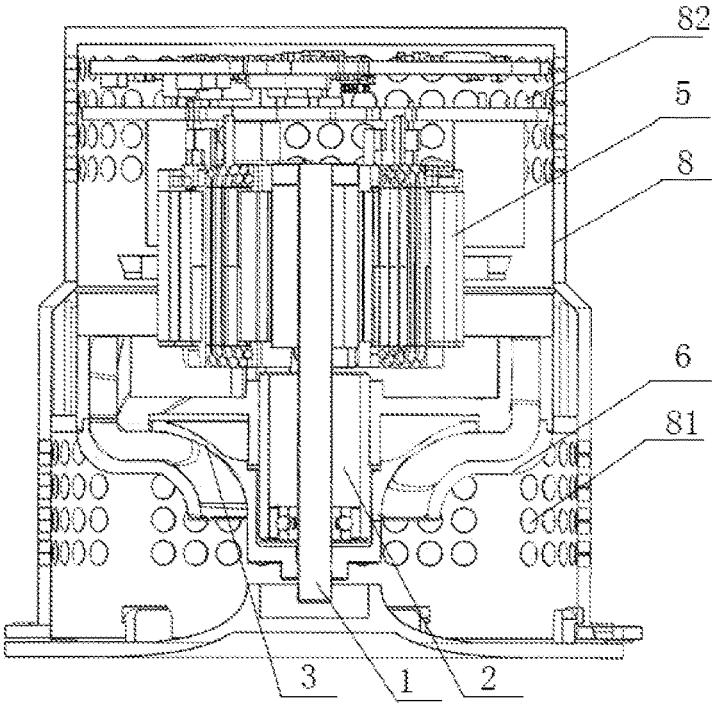
FIG. 5 is a structural schematic diagram of a cleaning device according to a fifth embodiment of the present disclosure.

FIG. 5 is a structural schematic diagram of a cleaning device according to a fifth embodiment of the present disclosure.

As shown in FIG. 5, the cleaning device includes the fan according to the above embodiment and a housing 8. The housing 8 is provided with an air inlet 81 and an air outlet 82. The air inlet 81 and the air outlet 82 are spaced apart along the axial direction of the fan.

The air inlet 81 is close to the air hood 6, and the air outlet 82 is close to the stator 5 of the fan, so that air flowing out from the air outlet 82 can take away heat generated by winding coils disposed on the stator of the fan.

In some embodiments, there is a plurality of air inlets 81, and the plurality of air inlets 81 forms a plurality of rows of inlets that is uniformly disposed around the housing 8.

Optionally, the air inlet 81 is circular, or may certainly be square, elliptical, or the like.

In some embodiments, there is a plurality of air outlets 82, and the plurality of air outlets 82 forms a plurality of rows of outlets that is uniformly disposed around the housing 8.

Optionally, the air outlet 82 is circular, or may certainly be square, elliptical, or the like.

In some embodiments, a plurality of air outlets at least covers a periphery of the housing 8 corresponding to the circuit board 7, so that the air flowing out from the multi-stage axial diffuser can flow out from the outlets near the circuit board 7 after flowing through the stator 5, thereby improving a heat dissipation effect on the winding coils of the stator 5 and the circuit board 7.

In this embodiment, the air enters from the inlet of the housing 8 to the impeller chamber 61 through the air inlet of the air hood 6, flows into the axial diffuser 4 through the annular gridless channel 62 under the drive of the impeller chamber 61, and then flows out at a high speed. The diameter of an inner wall of the axial diffuser 4 is equal to an outer diameter of the stator 5, so that the air can smoothly flow out from the axial diffuser 4. Further, since the axial diffuser 4 is connected to the stator 5, the air flow from the axial diffuser 4 can directly flow to an outer side of the stator 5 to take away the heat on the surface of the stator 5 and the heat of the circuit board 7, so as to cool the winding coils of the stator 5 and the circuit board 7 better.

In the cleaning device according to the embodiment of the present disclosure, since the fan is provided with the axial diffuser 4, the chaotic air flow from the impeller 3 directly enters the multi-stage axial diffuser through the annular gridless channel 62, and tends to flow stably after being guided by diffusion vanes 43 of the multi-stage axial diffuser, thereby reducing vortexes in the flow channel. Further, since the multi-stage axial diffuser is disposed in this embodiment, the air flowing out can have a higher pressure and flow from the multi-stage axial diffuser to winding coils of the stator 5 and the circuit board 7, thereby quickly cooling the winding coils and the circuit board 7.

In some embodiments, the above cleaning device is, for example, a vacuum cleaner.

An embodiment of the present disclosure further provides a fan, which can lead the chaotic air flow from the impeller 3 of the fan to flow a regular flowing direction.

Figure 6:
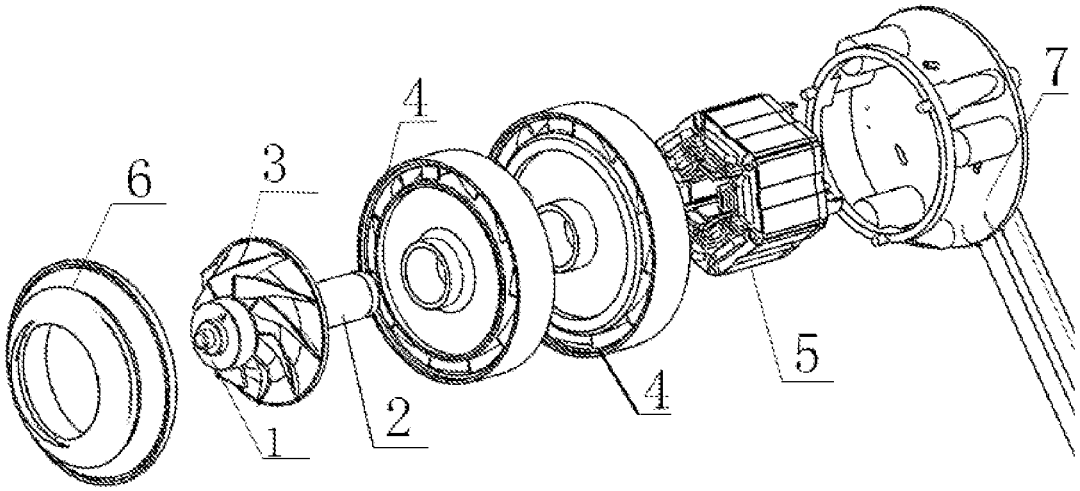
FIG. 6 is a structural schematic diagram of a fan according to a sixth embodiment of the present disclosure.

FIG. 6 is a structural schematic diagram of a fan according to a sixth embodiment of the present disclosure.

As shown in FIG. 6, the fan includes an impeller 3 and a multi-stage axial diffuser composed of at least two axial diffusers 4. A first-stage axial diffuser 4 in the multi-stage axial diffuser is connected to the impeller 3 through a first bearing assembly 2; a final-stage axial diffuser 4 in the multi-stage axial diffuser is connected to the stator 5, and each stage of the axial diffuser 4 is provided with an air inlet and an air outlet. In the multi-stage axial diffuser, the air outlet of a previous-stage axial diffuser 4 is docked with the air inlet of a next-stage axial diffuser 4.

In this embodiment, the fan is provided with the multi-stage axial diffuser, in which the air outlet of the previous-stage axial diffuser 4 is docked with the air inlet of the next-stage axial diffuser 4, so that the chaotic air introduced into the multi-stage axial diffuser through the impeller 3 tends to flow stably after being guided by diffusion vanes 43 of each stage of axial diffuser, thereby reducing vortexes in the flow channel, lowering the air resistance, decreasing the energy loss, and improving the operation efficiency of the fan.

In some embodiments, the number of blades 32 of the axial diffuser 4 is progressively increased from the first-stage axial diffuser 4 to the final-stage axial diffuser 4.

In some embodiments, the fan further includes an air hood 6 connected to the cylinder 41 of the first-stage axial diffuser 4 in the multi-stage axial diffuser. An end of the air hood 6 away from the first-stage axial diffuser 4 is provided with a central hole, and the impeller body 31 of the impeller 3 extends from the air hood 6 through the central hole of the air hood 6.

In some embodiments, the impeller 3 and the central hole of the air hood 6 are disposed coaxially, the impeller 3 is disposed in the impeller chamber 61 and used to introduce the air from the air inlet of the air hood 6, and the air enters the first-stage axial diffuser 4 in the multi-stage axial diffuser through the annular gridless channel 62 under the drive of the impeller 3, flows from the air inlet of the first-stage axial diffuser 4 to the diffusion air channel 44, and then flows from the air outlet of the first-stage axial diffuser 4 to the diffusion air channel 44 of the next-stage axial diffuser 4 sequentially, and finally flows out from the air outlet of the final-stage axial diffuser 4.

In some embodiments, one of the final-stage axial diffuser 4 in the multi-stage axial diffuser and the stator 5 includes a plurality of positioning columns 421, and the other of the final-stage axial diffuser 4 and the stator 5 includes a plurality of semicircular holes matching the positioning columns 421. The positioning columns 421 and the semicircular holes are disposed on the final-stage axial diffuser 4 and the stator 5 correspondingly and respectively, thereby facilitating the connection and fixing between the axial diffuser 4 and the stator 5.

In some embodiments, the fan further includes a rotor 1, a first bearing assembly 2 and an impeller 3.

The first bearing assembly 2 is disposed at an outer side of an end of the rotor 1. The impeller 3 includes an impeller body 31, the impeller body 31 is provided with a receiving cavity for receiving the first bearing assembly 2, and an end of the first bearing assembly 2 is disposed in the receiving cavity. The rotor 1, the first bearing assembly 2 and the impeller body 31 of the impeller 3 are disposed coaxially.

In the fan according to this embodiment, the end of the first bearing assembly 2 is embedded into the impeller 3 of the fan, so that the axial length of the fan and thus the overall length of the fan are reduced, and the axial volume of the fan is decreased. The shaft extension at the blade side is shortened, thereby enhancing the rigidity of the first bearing assembly 2 at this side and improving the stability of the blades.

Still another embodiment of the present disclosure provides a fan, which can cool winding coils of a stator to improve a heat dissipation effect of the fan.

The fan includes an axial diffuser 4, a stator 5 and a circuit board 7 that are sequentially disposed in an axial direction of the fan. The stator 5 is connected to the axial diffuser 4, the circuit board 7 is connected to the stator 5, and the axial diffuser 4, the stator 5 and the circuit board 7 are disposed coaxially.

The axial diffuser 4 includes a cylinder 41 and a diffuser body 42. A diameter of an inner wall of the diffuser body 42 is equal to an outer diameter of the stator 5.

In the fan according to this embodiment, since the diameter of the inner wall of the diffuser body 42 of the axial diffuser 4 is equal to the outer diameter of the stator 5, the air flowing out from the diffusion air channel 44 of the axial diffuser 4 can flow through an outer side of the stator 5 to dissipate the heat of the stator 5 and the circuit board 7, so that the fluid can smoothly flow out from the axial diffuser 4 through the outer side of the stator 5, thereby reducing the air resistance and improving the fluid efficiency.

In some embodiments, the axial diffuser 4 is a multi-stage axial diffuser composed of at least two axial diffusers 4. In the multi-stage axial diffuser, the diameter of the inner wall of the diffuser body of at least the final-stage axial diffuser 4 is equal to the outer diameter of the stator 5.

In some embodiments, since the diameter of the inner wall of the diffuser body 42 of the axial diffuser 4 is equal to the outer diameter of the stator 5, the air flowing out from the diffusion air channel 44 of the axial diffuser 4 can flow through the outer side of the stator 5. In the embodiment of the present disclosure, the diameter of the inner wall of the diffuser body 42 is equal to the outer diameter of the stator 5, so that the air can smoothly flow out from the axial diffuser 4 through the outer side of the stator 5, thereby reducing the air resistance and improving the fluid efficiency.

In some embodiments, in the multi-stage axial diffuser, the diameter of the inner wall of the diffuser body 42 of each stage of axial diffuser 4 is equal to the outer diameter of the stator.

In some embodiments, the diameter of the inner wall of the diffuser body 42 of the final-stage axial diffuser 4 is slightly greater than the outer diameter of the stator 5.

Specifically, the diffuser body 42 of the final-stage axial diffuser 4 is recessed in a direction away from the stator 5 to form a receiving groove for receiving the stator 5, so that the stator 5 and the diffuser body 42 can be assembled tightly.

In some embodiments, the axial diffusers 4 are coaxially disposed as the multi-stage axial diffuser, the first-stage axial diffuser 4 in the multi-stage axial diffuser is connected to the air hood 6 of the fan, and the final-stage axial diffuser 4 in the multi-stage axial diffuser is fixedly connected to the stator 5 of the fan.

In some embodiments, each stage of the axial diffuser 4 is provided with an air outlet and an air inlet, and n the multi-stage axial diffuser, the air outlet of a previous-stage axial diffuser 4 is docked with the air inlet of a next-stage axial diffuser 4.

In this embodiment, the fan is provided with the multi-stage axial diffuser, in which the air outlet of the previous-stage axial diffuser 4 is docked with the air inlet of the next-stage axial diffuser 4, so that the chaotic air introduced into the multi-stage axial diffuser through the impeller 3 tends to flow stably after being guided by diffusion vanes 43 of each stage of axial diffuser 4, thereby reducing vortexes in the flow channel, lowering the air resistance, decreasing the energy loss, and improving the operation efficiency of the fan.

In some embodiments, each stage of axial diffuser 4 includes a cylinder 41, and a diffuser body 42 and a diffusion vane 43 that are disposed in the cylinder 41. The diffusion vane 43 is disposed between the cylinder 41 and the diffuser body 42 and obliquely disposed along an axial direction of the cylinder 41.

In some embodiments, one end of the diffusion vane 43 is connected to an inner wall of the cylinder 41, and the other end of the diffusion vane 43 is connected to an outer wall of the diffuser body 42.

There is a plurality of diffusion vanes 43, and the plurality of diffusion vanes 43 is uniformly disposed in an annular channel formed by the cylinder 41 and the diffuser body 42, and divides the annular channel into a plurality of diffusion air channels 44.

In some embodiments, the diffusion vane 43 is of, for example, a sheet-like structure.

In some embodiments, the center of the diffuser body 42 is provided with a central shaft hole 422, and the first bearing assembly 2 is disposed in the central shaft hole 422 of the diffuser body 42.

In some embodiments, the fan further includes an air hood 6 connected to the cylinder 41 of the first-stage axial diffuser 4 in the multi-stage axial diffuser.

An end of the air hood 6 away from the first-stage axial diffuser 4 is provided with a central hole, and the impeller body 31 of the impeller 3 passes through the central hole of the air hood 6 and extends from the air hood 6. The fan has a compact structure, and is more beneficial to introducing the airflow into the fan.

In some embodiments, an impeller chamber 61 is disposed in the air hood 6, and the impeller 3 is disposed in the impeller chamber 61. The air hood 6 and the first-stage axial diffuser 4 form an annular gridless channel 62 surrounding the impeller chamber 61, the annular gridless channel 62 is communicated with the impeller chamber 61 and the air inlet of the first-stage axial diffuser 4, and the air hood 6 is provided with an air inlet.

In some embodiments, the impeller 3 and the central hole of the air hood 6 are disposed coaxially, the impeller 3 is disposed in the impeller chamber 61 and used to introduce the air from the air inlet of the air hood 6, and the air enters the first-stage axial diffuser 4 in the multi-stage axial diffuser through the annular gridless channel 62 under the drive of the impeller 3, flows from the air inlet of the first-stage axial diffuser 4 to the diffusion air channel 44, and then flows from the air outlet of the first-stage axial diffuser 4 to the diffusion air channel 44 of the next-stage axial diffuser 4 sequentially, and finally flows out from the air outlet of the final-stage axial diffuser 4.

In some embodiments, a first annular protrusion 411 is provided on an end face of a side of the cylinder 41 of the first-stage axial diffuser 4 close to the air hood 6 to form a first stepped face on the end face of the cylinder 41 of the first-stage axial diffuser 4, wherein the annular protrusion is formed by a side of an outer wall surface of the cylinder 41 of the first-stage axial diffuser 4 extending axially. A second annular protrusion 63 is provided on an end face of a side of the air hood 6 close to the first-stage axial diffuser 4 to form a second stepped face on the end face of the air hood 6 connected to the cylinder 41 of the first-stage axial diffuser 4. The second stepped face matches the first stepped face.

In this embodiment, the stepped face is disposed at a location where the cylinder 41 of the first-stage axial diffuser 4 is connected to the air hood 6, so that the smoother transition of an inner wall surface of the location where the air hood 6 is connected to the cylinder 41 can be achieved, thereby reducing the disturbance to the fluid.

In some embodiments, one of the final-stage axial diffuser 4 in the multi-stage axial diffuser and the stator 5 includes a plurality of positioning columns 421, and the other of the final-stage axial diffuser 4 and the stator 5 includes a plurality of semicircular holes matching the positioning columns 421. The positioning columns 421 and the semicircular holes are disposed on the final-stage axial diffuser 4 and the stator 5 correspondingly and respectively, thereby facilitating the connection and fixing between the axial diffuser 4 and the stator 5.

Preferably, the positioning column 421 is disposed on a side of the final-stage axial diffuser 4 close to the stator 5, and the semicircular hole matching the positioning column 421 is disposed on the stator 5.

In some embodiments, there are three positioning columns 421, and the three positioning columns 421 are distributed in an isosceles triangle in a circumferential direction of the axial diffuser 4. The three positioning columns 421 can ensure the positioning of the axial diffuser 4 and the stator 5. The positioning columns 421 being uniformly distributed in the circumferential direction of the axial diffuser 4 can realize the assembly of the axial diffuser 4 and the stator 5.

In some embodiments, the positioning column 421 extends along the axial direction of the axial diffuser 4. In an embodiment of the present disclosure, the positioning column 421 is disposed to extend along the axial direction of the axial diffuser 4, so that the positioning column 421 can have a sufficient strength without affecting a structure of the axial diffuser 4, and the material consumption can be reduced at the same time.

According to a third aspect of the present disclosure, there is further provided a fan. The fan includes an axial diffuser 4, a stator 5 and a circuit board 7 that are sequentially disposed in an axial direction of the fan. The stator 5 is connected to the axial diffuser 4 and the circuit board 7 is connected to the stator 5. The axial diffuser 4, the stator 5 and the circuit board 7 are disposed coaxially; and the axial diffuser 4 includes a cylinder 41 and a diffuser body 42, and the diameter of an inner wall of the diffuser body 42 is equal to an outer diameter of the stator 5.

In some embodiments, the axial diffuser 4 is a multi-stage axial diffuser composed of at least two axial diffusers 4. In the multi-stage axial diffuser, the diameter of the inner wall of the diffuser body of at least the final-stage axial diffuser 4 is equal to the outer diameter of the stator 5.

In some embodiments, in the multi-stage axial diffuser, the diameter of the inner wall of the diffuser body 42 of each stage of axial diffuser 4 is equal to the outer diameter of the stator 5.

In some embodiments, a first-stage axial diffuser 4 in the multi-stage axial diffuser is connected to an air hood 6 of the fan, and a final-stage axial diffuser 4 in the multi-stage axial diffuser is fixedly connected to the stator 5 of the fan.

In some embodiments, each stage of the axial diffuser 4 is provided with an air outlet and an air inlet, and in the multi-stage axial diffuser, the air outlet of a previous-stage axial diffuser 4 is docked with the air inlet of a next-stage axial diffuser 4.

In some embodiments, the number of blades 32 of the axial diffuser 4 is progressively increased from the first-stage axial diffuser 4 to the final-stage axial diffuser 4.

In some embodiments, the fan further includes the air hood 6 connected to the cylinder 41 of the first-stage axial diffuser 4 in the multi-stage axial diffuser. An end of the air hood 6 away from the first-stage axial diffuser 4 is provided with a central hole, and the impeller body 31 of the impeller 3 passes through the central hole of the air hood 6 and extends from the air hood 6.

According to another aspect of the present disclosure, there is provided a fan. Referring to FIG. 4, the fan includes a rotor 1, a first bearing assembly 2, an impeller 3 and an air hood 6. The rotor 1, the first bearing assembly 2, the impeller 3 and the air hood 6 are disposed coaxially; the first bearing assembly 2 is disposed at an outer side of an end of the rotor 1; the impeller 3 is disposed at an outer side of an end of the first bearing assembly 2 in contact with the rotor 1, and the air hood 6 is used to receive the impeller 3. An end of the impeller 3 in contact with the first bearing assembly 2 and an end of the first bearing assembly 2 close to the impeller 3 pass through and protrude from the air hood 6.

In some embodiments, the impeller 3 includes an impeller body 31, the impeller body 31 is provided with a receiving cavity for receiving the first bearing assembly 2, and one end of the first bearing assembly 2 is disposed in the receiving cavity.

In some embodiments, the fan further includes an axial diffuser 4 disposed between the impeller 3 and the stator 5 along an axial direction of the rotor 1, and the other end of the first bearing assembly 2 is disposed in a central shaft hole of the axial diffuser 4. Specifically, the axial diffuser 4 sleeves the other end of the first bearing assembly 2.

In some embodiments, the axial diffuser 4 includes a cylinder 41, and a diffuser body 42 and a diffusion vane 43 that are disposed in the cylinder 41, wherein the diffusion vane 43 is disposed between the cylinder 41 and the diffuser body 42 and obliquely disposed along an axial direction of the cylinder 41.

In some embodiments, there is a plurality of axial diffusers 4, and the plurality of axial diffusers 4 is coaxially disposed to form a multi-stage axial diffuser; and a first-stage axial diffuser 4 in the multi-stage axial diffuser sleeves the first bearing assembly 2, and a final-stage axial diffuser 4 in the multi-stage axial diffuser is fixedly connected to the stator 5.

In some embodiments, the diameter of an inner wall of the diffuser body 42 of at least the final-stage axial diffuser 4 in the multi-stage axial diffuser is equal to the outer diameter of the stator 5.

In some embodiments, since the diameter of the inner wall of the diffuser body 42 of the axial diffuser 4 is equal to the outer diameter of the stator 5, the air flowing out from the diffusion air channel 44 of the axial diffuser 4 can flow through an outer side of the stator 5.

In some embodiments, in the multi-stage axial diffuser, an air outlet of a previous-stage axial diffuser 4 is docked with an air inlet of a next-stage axial diffuser 4, so that the multi-stage axial diffuser may be of a series-connection structure.

In some embodiments, a circuit board 7 is further included. The circuit board 7 is electrically connected to winding coils of the stator 5, and disposed at an end of the stator 5 away from the axial diffuser 4.

In some embodiments, the air hood 6 is connected to the cylinder 41 of the first-stage axial diffuser 4 in the multi-stage axial diffuser.

It should be understood that the above specific embodiments of the present disclosure are merely intended to exemplarily illustrate or explain the principles of the present disclosure rather than constitute limitations to the present disclosure. Therefore, any modifications, equivalent substitutions, improvements, and the like made without departing from the spirit and scope of the present disclosure shall be encompassed in the protection scope of the present disclosure. In addition, the appended claims of the present disclosure are intended to cover all variations and modifications falling within the scope of the appended claims or the equivalents of such a scope.

What is claimed is:

1. A fan, comprising:

a rotor;

a stator;

a first bearing assembly disposed at a radial outer side of an end of the rotor; and an impeller comprising an impeller body, wherein the impeller body is provided with a receiving cavity for receiving the first bearing assembly; one end of the first bearing assembly is disposed in the receiving cavity; and the rotor, the first bearing assembly and the impeller body are disposed coaxially, wherein the first bearing assembly comprises a first bearing and a second bearing closer to the stator than the first bearing, a shaft extension of the fan is smaller than a axial distance between the first bearing and the second bearing, and the shaft extension is a distance, along an axial direction of the fan, from a tail end of the rotor protruding out of the impeller to a center position of the first bearing, wherein the fan further comprises an axial diffuser, the axial diffuser is disposed between the impeller and the stator along an axial direction of the rotor, and the other end of the first bearing assembly is disposed in a central hole of the axial diffuser.

2. The fan according to claim 1, wherein the axial diffuser comprises a cylinder, and a diffuser body and a diffusion vane disposed in the cylinder, and the diffusion vane is disposed between the cylinder and the diffuser body and obliquely disposed along an axial direction of the cylinder.

3. The fan according to claim 2, wherein a surface of the diffuser body is recessed in a direction away from the stator to form a recess, and an inner contour of the recess matches an outer contour of the stator, thereby receiving a part of the stator in the recess.

4. The fan according to claim 1, wherein there is a plurality of axial diffusers, and the plurality of axial diffusers are coaxially disposed to form a multi-stage axial diffuser; and a first-stage axial diffuser in the multi-stage axial diffuser sleeves the first bearing assembly, and a final-stage axial diffuser in the multi-stage axial diffuser is fixedly connected to the stator.

5. The fan according to claim 4, wherein an inner wall diameter of a diffuser body of the final-stage axial diffuser is greater than an outer diameter of the stator.

6. The fan according to claim 1, wherein the impeller is provided with a plurality of blades, and a number of the blades is odd.

7. A cleaning device, comprising a fan, wherein the fan comprises:

a rotor;

a stator;

a first bearing assembly disposed at a radial outer side of an end of the rotor; and an impeller comprising an impeller body, wherein the impeller body is provided with a receiving cavity for receiving the first bearing assembly; one end of the first bearing assembly is disposed in the receiving cavity; and the rotor, the first bearing assembly and the impeller body are disposed coaxially, wherein the first bearing assembly comprises a first bearing and a second bearing closer to the stator than the first bearing, a shaft extension of the fan is smaller than an axial distance between the first bearing and the second bearing, and the shaft extension is a distance, along an axial direction of the fan, from a tail end of the rotor protruding out of the impeller to a center position of the first bearing, wherein the fan further comprises an axial diffuser, the axial diffuser is disposed between the impeller and the stator along an axial direction of the rotor, and the other end of the first bearing assembly is disposed in a central hole of the axial diffuser.

8. The cleaning device according to claim 7, wherein the axial diffuser comprises a cylinder, and a diffuser body and a diffusion vane disposed in the cylinder, and the diffusion vane is disposed between the cylinder and the diffuser body and obliquely disposed along an axial direction of the cylinder.

9. The cleaning device according to claim 8, wherein a surface of the diffuser body is recessed in a direction away from the stator to form a recess, and an inner contour of the recess matches an outer contour of the stator, thereby receiving a part of the stator in the recess.

10. The cleaning device according to claim 7, wherein there is a plurality of axial diffusers, and the plurality of axial diffusers are coaxially disposed to form a multi-stage axial diffuser; and a first-stage axial diffuser in the multi-stage axial diffuser sleeves the first bearing assembly, and a final-stage axial diffuser in the multi-stage axial diffuser is fixedly connected to the stator.

11. The cleaning device according to claim 10, wherein an inner wall diameter of a diffuser body of the final-stage axial diffuser is greater than an outer diameter of the stator.

12. The cleaning device according to claim 7, wherein the impeller is provided with a plurality of blades, and a number of the blades is odd.

* * * * *